US008689769B2

(12) United States Patent
Afjeh et al.

(10) Patent No.: US 8,689,769 B2
(45) Date of Patent: Apr. 8, 2014

(54) COMPRESSION-BRAKING SYSTEM

(75) Inventors: Homa Afjeh, Dunlap, IL (US); Edwin Henry Langewisch, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 1001 days.

(21) Appl. No.: 12/662,937

(22) Filed: May 12, 2010

(65) Prior Publication Data

US 2011/0277729 A1 Nov. 17, 2011

(51) Int. Cl.
*F02D 13/04* (2006.01)

(52) U.S. Cl.
USPC ..... 123/321

(58) Field of Classification Search
USPC ..... 123/90.15, 90.16, 90.17, 321, 322, 347, 123/348, 90.11, 90.12, 198 F, 320
See application file for complete search history.

(56) References Cited

U.S. PATENT DOCUMENTS

| | | | | |
|---|---|---|---|---|
| 5,479,890 | A * | 1/1996 | Hu et al. | 123/322 |
| 5,564,373 | A | 10/1996 | Hara | |
| 5,839,453 | A * | 11/1998 | Hu | 123/322 |
| 6,152,104 | A | 11/2000 | Vorih et al. | |
| 6,234,143 | B1 | 5/2001 | Bartel et al. | |
| 6,244,257 | B1 | 6/2001 | Hu | |
| 6,354,254 | B1 | 3/2002 | Usko | |
| 6,422,186 | B1 | 7/2002 | Vanderpoel | |
| 6,655,349 | B1 * | 12/2003 | Cavanagh | 123/321 |
| 6,691,674 | B2 | 2/2004 | McCarthy et al. | |
| 6,769,405 | B2 | 8/2004 | Leman et al. | |
| 6,805,093 | B2 | 10/2004 | Zsoldos et al. | |
| 6,883,492 | B2 | 4/2005 | Vanderpoel et al. | |
| 7,069,888 | B2 | 7/2006 | Yang et al. | |
| RE39,258 | E * | 9/2006 | Cosma et al. | 123/321 |
| 7,464,675 | B1 | 12/2008 | Schechter | |
| 2003/0221663 | A1 * | 12/2003 | Vanderpoel et al. | 123/321 |
| 2004/0187842 | A1 | 9/2004 | Yang | |
| 2005/0188966 | A1 | 9/2005 | Ruggiero et al. | |
| 2007/0095312 | A1 * | 5/2007 | Vanderpoel et al. | 123/90.16 |
| 2008/0223325 | A1 | 9/2008 | Meistrick | |

FOREIGN PATENT DOCUMENTS

| | | |
|---|---|---|
| EP | 1221542 | 7/2002 |
| WO | 9610125 | 4/1996 |

* cited by examiner

*Primary Examiner* — Stephen K Cronin
*Assistant Examiner* — Sizo Vilakazi
(74) *Attorney, Agent, or Firm* — Finnegan, Henderson, Farabow, Garrett & Dunner, LLP

(57) ABSTRACT

A method is disclosed for controlling compression-braking performance of an engine having a piston in a combustion cylinder. The method may include providing a valve in fluid communication with the combustion cylinder and at least one valve actuator operable to control the valve to perform compression-braking by opening the valve, which may include opening the valve to a first peak-valve-opening during a compression stroke of the piston and opening the valve to a second peak-valve-opening before a second half of an expansion stroke of the piston. The method may also include determining a target value for a stress in the at least one valve actuator. Additionally, the method may include designing the magnitude and timing of the first peak-valve-opening as a function of the target for the stress in the at least one valve actuator.

20 Claims, 3 Drawing Sheets

FIG. 1B

COMPRESSION-BRAKING SYSTEM

TECHNICAL FIELD

The present disclosure relates to internal combustion engines and, more particularly, to compression-braking operation of internal combustion engines.

BACKGROUND

Many machines, such as vehicles, sometimes operate an internal combustion engine to provide engine-braking, where the engine consumes external energy (e.g., vehicle momentum). One type of engine-braking—compression-braking—uses the external energy to drive a piston of the engine during its compression stroke and then releases compressed gas from the combustion cylinder to reduce the amount of energy returned to the piston during the subsequent expansion stroke. To release compressed gas from the combustion cylinder, the engine typically opens a valve with one or more valve actuators. In many cases, the engine releases compressed gas from the combustion cylinder around the end of the compression stroke and/or the beginning of the expansion stroke. For example, some compression-ignition engines with unit-type fuel injection systems employ an injector cam of the injection system and a hydraulic actuator to open a valve around this part of the cycle.

Over the course of the compression stroke of the piston, the pressure in the combustion cylinder progressively rises, often reaching very high levels at the end of the compression stroke. The valve actuator(s) that open a valve to provide compression-braking must work against this pressure in the combustion cylinder, which generates stresses in the valve and the valve actuator(s). Depending on various parameters, the forces required to open the valve against the elevated pressures at the end of the compression stroke and/or the beginning of the expansion stroke may create undesirably or unacceptably high stresses in the valve actuator(s). Additionally, the higher the pressure rises in the combustion cylinder at the end of the compression stroke, the more noise it may produce when released, which may cause undesirably or unacceptably high noise levels from the engine during compression-braking mode. These concerns may prove particularly difficult to address in cases where concerns unrelated to compression-braking limit the ability to adjust the timing of the valve opening for compression-braking. For example, in applications that employ an injector cam to open the valve for compression-braking, considerations related to injector timing may limit the ability to adjust the valve timing to reduce stress in the valve actuator(s).

Published U.S. Patent Application No. 2008/0223325 A1 to Meistrick ("the '325 application") discusses a method that purportedly provides engine-braking with reduced forces on the valve actuator(s) used to implement the compression-braking, as well as reduced noise. Specifically, the '325 application discusses an engine-braking approach referred to as "bleeder type engine-braking." According to the '325 application this approach involves opening one or more valve(s) early in the compression stroke and holding them open at a constant level for an extended period. The '325 application states that this approach provides reduced forces on the valve actuator(s) used to open the valve(s) and noise output of the engine.

Although the '325 application discusses an engine-braking approach that purportedly reduces force on the valve actuator(s) used to implement it and noise output of the engine, certain disadvantages may persist. For example, holding the valve(s) open for an extended period may tend to reduce the amount of work the piston performs during the compression stroke, which may tend to compromise the amount of engine-braking power provided by the engine. Additionally, "bleeder type engine-braking" may not lend itself to certain applications, such as, for example, applications relying on an injector cam to open one or more valve(s) for compression-braking.

The compression-braking system and design of the present disclosure solves one or more of the problems set forth above.

SUMMARY OF THE INVENTION

One disclosed embodiment relates to a method for controlling compression-braking performance of an engine having a piston in a combustion cylinder. The method may include providing a valve in fluid communication with the combustion cylinder and at least one valve actuator operable to control the valve to perform compression-braking by opening the valve, which may include opening the valve to a first peak-valve-opening during a compression stroke of the piston and opening the valve to a second peak-valve-opening before a second half of an expansion stroke of the piston. The method may also include determining a target value for a stress in the at least one valve actuator. Additionally, the method may include designing the magnitude and timing of the first peak-valve-opening as a function of the target for the stress in the at least one valve actuator.

Another embodiment relates to an engine having a combustion cylinder and a piston disposed in the combustion cylinder. The engine may also include engine controls configured to operate the engine in a compression-braking mode, which engine controls may include a valve in fluid communication with the combustion cylinder, as well as an injector cam and at least one valve actuator that actuate the valve during compression-braking of the engine. The injector cam may include a first peak that drives the at least one valve actuator to increase an opening of the valve a first time to a first peak-valve-opening after about 120 crankshaft degrees before top dead center of a compression stroke of the piston during compression-braking mode. The injector cam may also include a second peak that drives the at least one valve actuator to increase the opening of the valve a second time to a second peak-valve-opening before a second half of an expansion stroke of the piston during compression-braking mode.

A further disclosed embodiment relates to a method of operating an engine having a piston in a combustion cylinder. The method may performing compression-braking with the engine, which may include releasing a first pulse of pressure from the combustion cylinder during a compression stroke of the piston. Performing compression-braking of the engine may further include, subsequent to releasing the first pulse of pressure from the combustion cylinder, releasing a second pulse of pressure from the combustion cylinder before a second half of an expansion stroke of the piston.

DETAILED DESCRIPTION

Figure 1A:
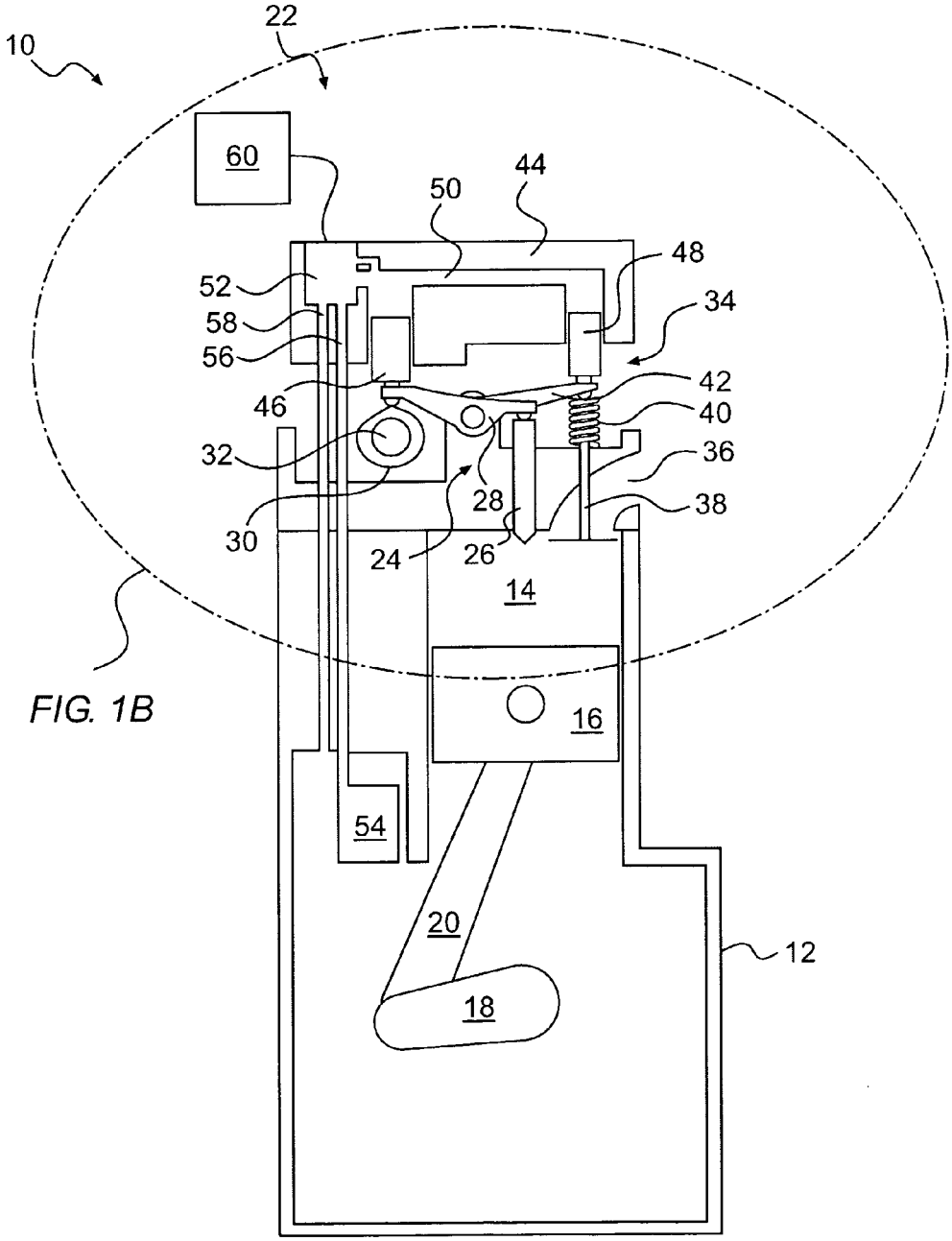
FIG. 1A is a schematic diagram of an engine according to the present disclosure.
Figure 1B:
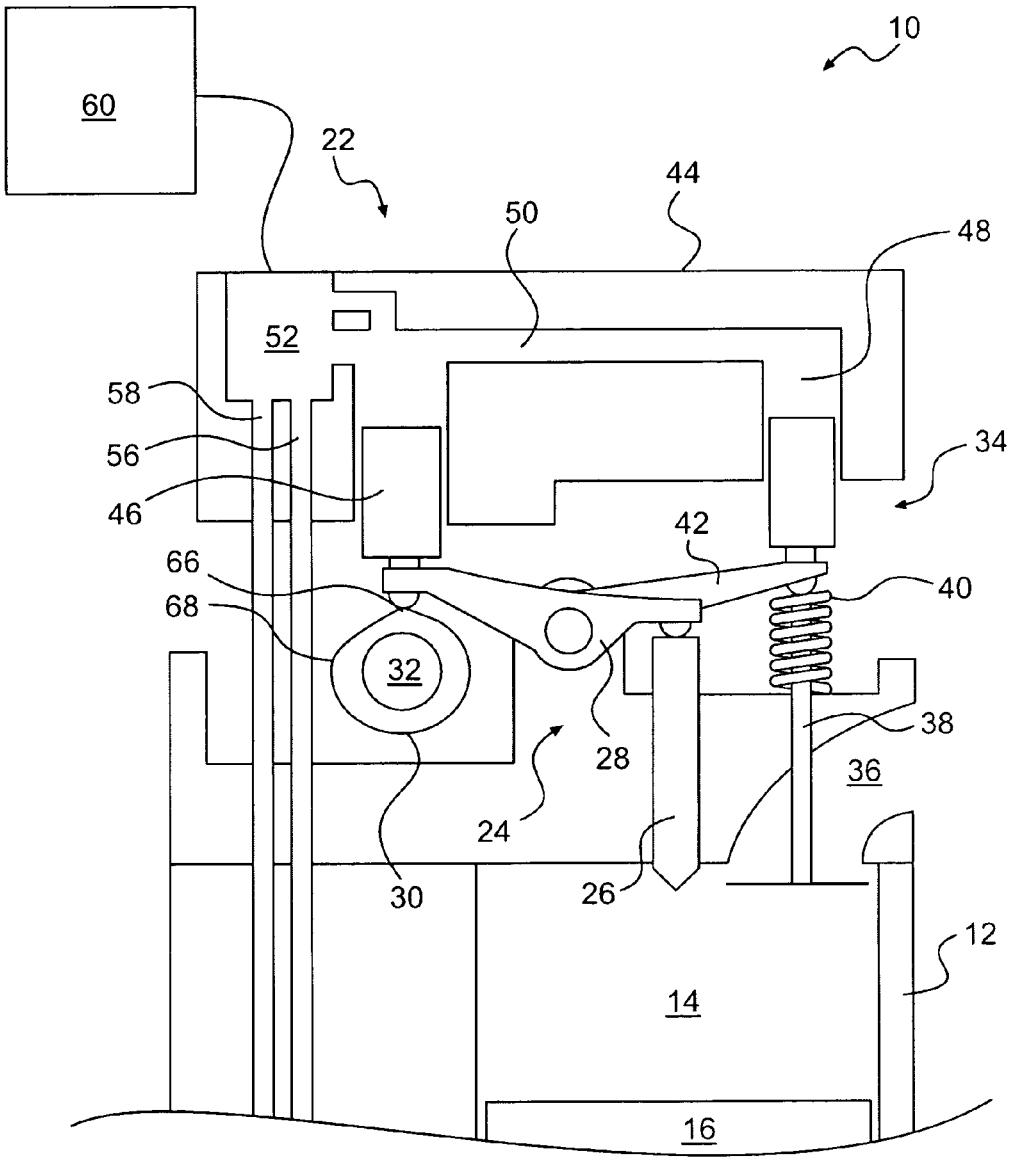
FIG. 1B is an enlarged view of a portion of FIG. 1A.

FIGS. 1A and 1B illustrate one embodiment of an engine 10 according to the present disclosure. Engine 10 may include a housing 12 with a combustion cylinder 14, a piston 16 disposed in combustion cylinder 14, and a crankshaft 18 connected to piston 16 by a connecting rod 20. In addition to combustion cylinder 14, piston 16, and connecting rod 20, engine 10 may include other combustion cylinders, pistons, and connecting rods (not shown). Engine 10 may be, for example, a compression-ignition engine.

Engine 10 may also include engine controls 22 that control various aspects of the operation of engine 10. Engine controls 22 may include a fuel system 24, which may include any suitable components for supplying fuel to combustion cylinder 14. Fuel system 24 may include a fuel injector 26 for injecting fuel into combustion cylinder 14 and various components (not shown) for supplying fuel to fuel injector 26. In some embodiments, fuel injector 26 may be a unit-type injector, and engine controls 22 may include an injector rocker 28 and an injector cam 30 on a camshaft 32 for actuating fuel injector 26. Engine controls 22 may include various provisions (not shown) for driving camshaft 32 in synchronism with crankshaft 18, including, but not limited to gears, sprockets, chains, and belts.

Engine controls 22 may also include an aspiration system 34 for selectively allowing gas to flow into and out of combustion cylinder 14. Aspiration system 34 may include a channel 36 extending from combustion cylinder 14 and a valve 38 situated to control fluid communication between combustion cylinder 14 and channel 36. In some embodiments, channel 36 may be an exhaust port, and valve 38 may be an exhaust valve.

Figure 2:
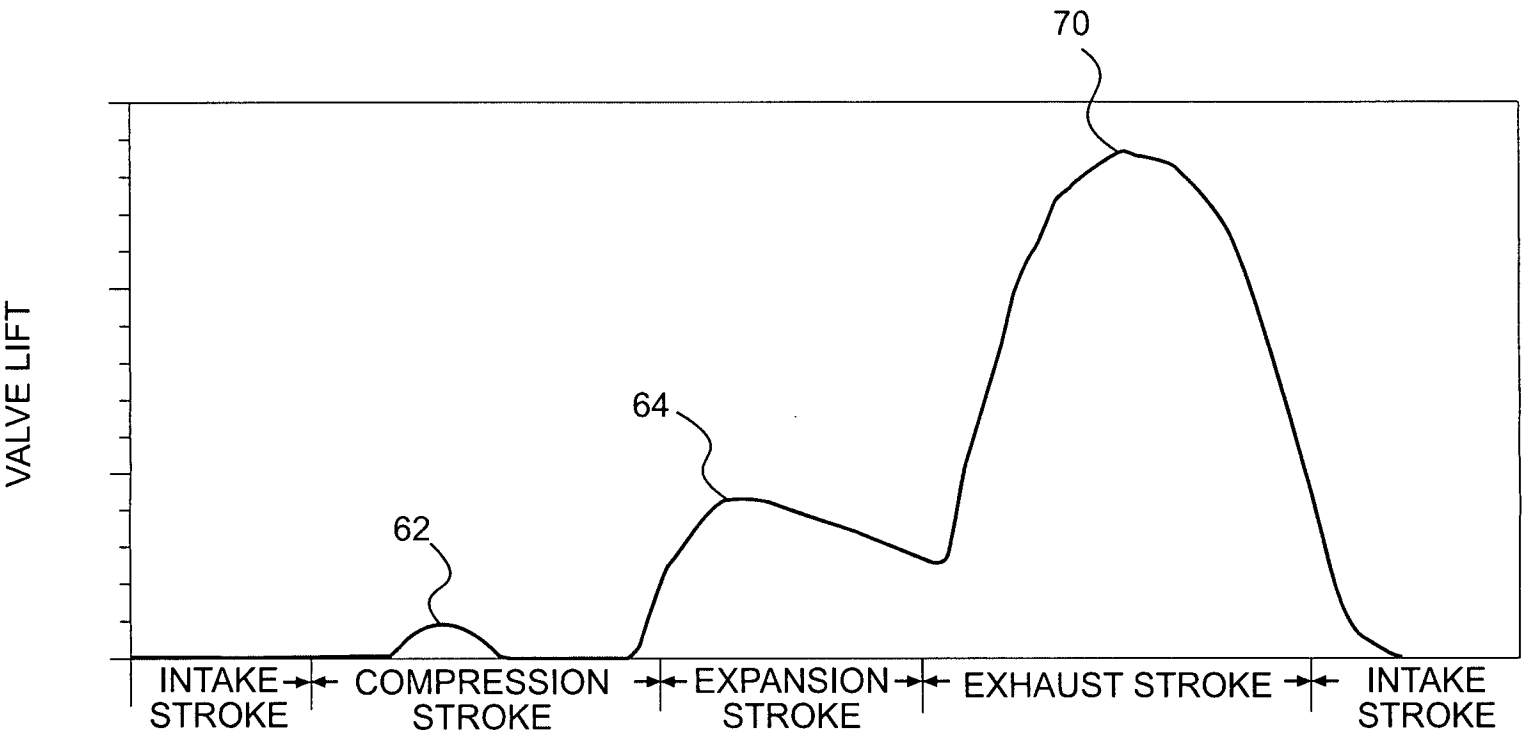
FIG. 2 graphically illustrates one example of how a valve may be controlled in a compression-braking system according to the present disclosure.

Engine controls 22 may also include one or more valve actuators for controlling valve 38. The one or more valve actuators may include any component or components operable to control timing and magnitude of valve opening in the manners discussed below. In some embodiments, the one or more valve actuators may include, for example, a valve spring 40, an exhaust rocker 42, and an exhaust cam (not shown) on camshaft 32. This series of valve actuators may serve to open valve 38 for a primary-exhaust-valve-event associated with each exhaust stroke of piston 16. FIG. 2 provides one example of how the opening of valve 38 may vary over the course of a primary-exhaust-valve-event 70.

One or more of the valve actuators of engine controls 22 may also be operable to open valve 38 during a compression stroke and/or an expansion stroke of piston 16 when engine controls 22 operate engine 10 in a compression-braking mode. FIG. 2 provides one example of how engine controls 22 may control the opening of valve 38 in compression-braking mode. To provide compression-braking, engine controls 22 may open valve 38 to a first peak-valve-opening 62 during a compression stroke of piston 16 and subsequently open valve 38 to a second peak-valve-opening 64 prior to primary-exhaust-valve-event 70.

Engine controls 22 may employ any of various types of actuators to control valve 38 in this manner in compression-braking mode. For example, as FIGS. 1A and 1B show, engine controls 22 may employ injector cam 30 and a hydraulic-braking-housing 44 to actuate valve 38 in this manner during compression-braking. As best shown in FIG. 1B, injector cam 30 may have a first peak 66 corresponding to first peak-valve-opening 62 and a second peak 68 corresponding to second peak-valve-opening 64. Hydraulic-braking-housing 44 may be operable to selectively transmit movement generated with first peak 66 and second peak 68 to valve 38.

Hydraulic-braking-housing 44 may include a master piston 46 and a slave piston 48 connected by a hydraulic passage 50, as well as control valving 52 in fluid communication with hydraulic passage 50. Master piston 46 may be situated so that injector cam 30 actuates master piston 46. For example, master piston 46 may ride on an end of injector rocker 28 actuated by injector cam 30. Slave piston 48 may be situated to allow it to actuate valve 38. For example, slave piston 48 may be disposed adjacent an end of exhaust rocker 42 that actuates valve 38, so that slave piston 48 may actuate valve 38 through exhaust rocker 42.

Control valving 52 may be configured to control flow of hydraulic fluid, such as engine oil, to and from hydraulic passage 50. Control valving 52 may connect to an oil pump 54 of engine 10 through a supply line 56. At least one operating state of control valving 52 may allow hydraulic fluid from supply line 56 to fill hydraulic passage 50. Additionally, control valving 52 may have at least one operating state allowing hydraulic fluid in hydraulic passage 50 to escape through a drain line 58. With control valving 52 in such an operating state, master piston 46 may move freely without driving slave piston 48 or valve 38, as any hydraulic fluid displaced by movement of master piston 46 may escape through drain line 58.

Control valving 52 may also have at least one operating state preventing hydraulic fluid from leaving hydraulic passage 50. When control valving 52 has such an operating state, the hydraulic fluid trapped in hydraulic passage 50 may drive slave piston 48 in response to any motion of master piston 46. During such operation, when first peak 66 and second peak 68 of injector cam 30 move master piston 46, slave piston 48 moves in response, opening valve 38 to first peak-valve-opening 62 and second peak-valve-opening 64, respectively.

Control valving 52 may include any arrangement of one or more valve(s) capable of providing these functions, including, but not limited to, solenoid valve(s) and check valve(s). Control valving 52 may be operatively connected to and controlled by one or more other components of engine controls 22 that control the operating state of control valving 52. For example, control valving 52 may be operatively connected to an engine control unit (ECU) 60, which may include one or more memory devices and/or one or more processor devices for controlling the operating state of control valving 52.

In addition to the above-discussed components, engine controls 22, fuel system 24, and aspiration system 34 may include various other features. For example, aspiration system 34 may have one or more intake valve(s) and intake channel(s) (not shown) for supplying gases to combustion cylinder 14, as well as one or more valve actuator(s) (not shown) for controlling such intake valve(s). Additionally, aspiration system 34 may include one or more additional exhaust channel(s) and/or exhaust valve(s) associated with combustion cylinder 14, as well as one or more valve actuator(s) for controlling any such additional exhaust valve(s). Further, engine controls 22, fuel system 24, and aspiration system 34 may include features like those discussed above for any additional combustion cylinder(s) of engine 10.

Engine controls 22 and aspiration system 34 are not limited to the configurations discussed above. For example, engine controls 22 may include various other types of valve actuator(s) operable to control valve 38 in the disclosed manners when operating engine 10 in compression-braking mode, including, but not limited to, other types of mechanical, hydraulic, electromechanical, and/or pneumatic actuators. Such other types of valve actuator(s) may include one or more actuator(s) that also serve to actuate fuel injector 26, or engine controls 22 may actuate valve 38 in compression-braking mode with valve actuator(s) separate from the components used to actuate fuel injector 26. For example, engine controls 22 may employ one or more valve actuator(s) associated with an intake or exhaust valve of a combustion cylinder other than combustion cylinder 14 to actuate valve 38 in compression-braking mode. Alternatively, the one or more valve actuator(s) used to actuate valve 38 in compression-braking mode may be dedicated exclusively to that purpose. Further, in addition to or instead of valve 38, aspiration system 34 may include one or more other valves that engine controls 22 actuate to effect compression-braking, including, but not limited to, one or more other exhaust valve(s) and/or one or more valves dedicated exclusively to the purpose of compression-braking.

Additionally, fuel system 24 and engine 10 may have a different configuration than that discussed above and shown in FIGS. 1A and 1B. For example, fuel system 24 may be a type of fuel system other than a unit-injection type system, including, but not limited to a system with a dedicated injection pump, a common-rail type system, or any other system suitable for supplying fuel to combustion cylinder 14. Additionally, in some embodiments, engine 10 may be a spark-ignition or other type of engine, rather than a compression-ignition engine.

INDUSTRIAL APPLICABILITY

Engine 10 may have use in any application where the ability to provide either power production or engine-braking may prove beneficial. To produce power, engine 10 may, for example, execute a conventional four-stroke cycle including an intake stroke, compression stroke, expansion stroke, and exhaust stroke of piston 16. During such operation, fuel injector 26 may use energy from its actuation by injector cam 30 and injector rocker 28 to inject fuel into combustion cylinder 14 around the end of the compression stroke and/or the beginning of the expansion stroke of piston 16. Subsequently, engine controls 22 may effect scavenging of combustion cylinder 14 during the exhaust stroke by opening valve 38 at primary-exhaust-valve-event 70 starting during the expansion stroke or the exhaust stroke of piston 16 (FIG. 2).

When operating engine 10 to produce power, engine controls 22 may leave valve 38 closed other than for primary-exhaust-valve-event 70, omitting first peak-valve-opening 62 and second peak-valve-opening 64. Engine controls 22 may do so, for example, by operating control valving 52 to allow master piston 46 to move in response to injector cam 30 without driving slave piston 48 or valve 38, as discussed above. As a result, only the exhaust cam (not shown) on camshaft 32 and exhaust rocker 42 actuate valve 38 during such operation.

In compression-braking mode, engine controls 22 may control fuel injector 26 to discontinue the injection of fuel into combustion cylinder 14, while also operating to open valve 38 to the first peak-valve-opening 62 and the second peak-valve-opening 64 before primary-exhaust-valve-event 70. To execute the first and second peak-valve-openings 62, 64, engine controls 22 may, for example, operate control valving 52 to seal hydraulic passage 50, so that actuation of master piston 46 by first peak 66 and second peak 68 of injector cam 30 drives slave piston 48 to open valve 38. Venting combustion cylinder 14 prior to primary-exhaust-valve-event 70 may provide compression-braking by releasing at least some of the energy stored in the gases compressed during the compression stroke, rather than returning that energy to piston 16 during the expansion stroke.

The disclosed approach of opening valve 38 to first peak-valve-opening 62 during the compression stroke before opening valve 38 to second peak-valve-opening 64 may significantly enhance the ability to design the compression-braking mode to provide high levels of braking power without generating undesirably high stresses in certain components of engine controls 22 or undesirably high noise from engine 10 in compression-braking mode. As discussed above, overcoming the pressure in combustion cylinder 14 to open valve 38 near the end of the compression stroke and/or the beginning of the expansions stroke can generate large stresses in valve 38 and/or the one or more of the valve actuator(s) used to open valve 38. By implementing first peak-valve-opening 62 in a manner to release a first pulse of pressure and gas from combustion cylinder 14, the disclosed approach allows reducing the pressure to which the gases in combustion cylinder 14 rise at the end of the compression stroke. This may tend to reduce the stresses generated in opening valve 38 to second peak-valve-opening 64 to release a second pulse of pressure and gas from combustion cylinder 14. It may also tend to reduce the amount of noise generated during second peak-valve-opening 64, thereby suppressing the noise output of engine 10 in compression-braking mode.

Additionally, employing two distinct valve opening events may tend to maintain the braking power produced by engine 10 relatively high. By decreasing the opening of valve 38 between first and second peak-valve-openings 62, 64, engine controls 22 may help retain some gas in combustion cylinder 14 and force piston 16 to continue working to compress that retained gas through the period between first and second peak-valve-openings 62, 64. As shown in FIG. 2, in some embodiments, engine controls 22 may fully close valve 38 between first peak-valve-opening 62 and second peak-valve-opening 64. The work done to compress the gases in combustion cylinder 14 between first peak-valve-opening 62 and second peak-valve-opening 64 may contribute significantly to the braking power produced by engine 10 in compression-braking mode.

The disclosed approach for reducing stress in valve 38 and the associated valve actuator(s) may prove particularly beneficial in applications where other considerations limit the ability to design the timing and profile of second peak-valve-opening 64 based on compression-braking considerations. For example, embodiments like that shown in FIGS. 1A and 1B that use an injector cam 30 may particularly benefit from the disclosed approach. As mentioned above, considerations related to fuel-injection timing and magnitude may dictate the profile of the portion of injector cam 30 corresponding to the end of the compression stroke and the beginning of the expansion stroke, i.e., the profile of second peak 68. As a result, there may be little or no flexibility to adjust the timing and profile of second peak-valve-opening 64 based on considerations related to compression-braking. On the other hand, the designer may have a great deal of freedom to tailor the timing and profile of first peak-valve-opening 62 based primarily or even exclusively on considerations related to compression-braking parameters, including, but not limited to, component stress levels and braking power.

Various approaches may be used to design the profile and timing of first peak-valve-open ing 62 and/or second peak-valve-opening 64 and, thus, the timing and magnitude of the first and second pulses of pressure released from combustion cylinder 14 during compression-braking mode. The process of designing these aspects of compression-braking mode may include determining a target for one or more parameters related to compression-braking mode. In some cases, the process may involve determining a target for a stress level in one or more of the valve actuators of engine controls 22 and/or a target for one more other stress-related parameters. For example, the design process may include determining a target level for the pressure in hydraulic passage 50 of hydraulic-braking-housing 44. A target level for this pressure may represent, for instance, a pressure or range of pressures that will not compromise the integrity or operation of hydraulic-braking-housing 44. Similarly, the process may additionally or alternatively involve determining a target level for a peak pressure in combustion cylinder 14 during compression-braking mode. A target level for the cylinder pressure may correspond, for example, to a stress level in one or more valve actuator(s) that will not compromise their integrity or operation and/or to a desired noise output level for engine 10 in compression-braking mode.

In addition to determining a target for one or more stresses and/or stress-related parameter(s), the design process may involve determining a target for one or more other parameters related to compression-braking. For example, a target compression-braking power output may be determined. Additionally, a target value for noise output of engine 10 in compression-braking mode may be determined. Any target(s) for compression-braking power, noise output, stress-related parameter(s), and/or other parameters, may be selected for various operating conditions. In some cases, the design process may involve determining the target(s) at least for compression-braking mode with the engine operating at its "rated" speed.

With target value(s) determined for one or more parameters related to compression-braking, the design process may involve configuring the timing and profile of first peak-valve-opening 62 and/or second peak-valve-opening 64 and the timing and magnitude of the corresponding first and second pulses of pressure and gas released thereby, as a function of those target(s). For example, after an initial design of first peak-valve-opening 62 and/or the second peak-valve-opening 64 is completed, analysis may be performed to determine whether the design achieves the selected target(s). If not, the timing and/or profile of first peak-valve-opening 62 and/or second peak-valve-opening 64 may be modified, after which the new design may be analyzed to evaluate whether it achieves the target(s). This process may be iterated as many times as desired for the purpose of moving the design closer to achieving the target(s).

The timing of first peak-valve-opening 62 and second peak-valve-opening 64 may be adjusted in various ways to achieve the design target(s) for the compression-braking parameter(s). For example, it has been found that, for at least some applications and ranges of timing, advancing first peak-valve-opening 62 to earlier points in the compression stroke may tend to result in less peak pressure in combustion cylinder 14 and, correspondingly, less stress on valve 38 and the valve actuator(s) that open valve 38, as well as less noise output in compression-braking mode. Also, it has been found that, for at least some applications and timing values, increasing the magnitude of first peak-valve-opening 62 similarly tends to result in less peak pressure in combustion cylinder 14 and less stress in valve 38 and the associated valve actuator(s), as well as less noise output. Thus, achieving target value(s) for the compression-braking design target(s) may be accomplished largely through the selection of the timing and/or magnitude of first peak-valve-opening 62 to provide a desirable timing and magnitude of the pulse of pressure and gas released thereby. In some cases, such as where fuel-injection considerations largely dictate the design of second peak-valve-opening 64, the process of designing to achieve the compression-braking target(s) may primarily or exclusively involve designing first peak-valve-opening 62.

The particular timing chosen for first peak-valve-opening 62 and second peak-valve-opening 64 may depend in large part on the particulars of the application, including, but not limited to, the strength of the various actuator(s) used to control valve 38, the target level of braking power, the compression ratio of the engine, and the expected pressure levels in channel 36 during compression-braking mode. For at least some applications, it has been found that separating first peak-valve-opening 62 and second peak-valve-opening 64 by an amount between about 90 and 210 crankshaft degrees of rotation may work well. With such timing, first peak-valve-opening 62 may release a first pulse of pressure and gas from combustion cylinder 14 between about 90 and 210 crankshaft degrees before second peak-valve-opening 64 releases a second pulse of pressure and gas from combustion cylinder 14. In some embodiments, first peak-valve-opening 62 may occur between about 120 and 60 crankshaft degrees before top dead center of the compression stroke, and second peak-valve-opening 64 may occur between about 30 and 90 crankshaft degrees after top dead center of the expansion stroke. Further, in some embodiments, first peak-valve-opening 62 may occur between about 90 and 60 crankshaft degrees before top dead center of the compression stroke.

The magnitudes chosen for first peak-valve-opening 62 and second peak-valve-opening 64 (and thus the magnitude of the corresponding release of the first and second pulses of pressure and gas) may also depend largely on various aspects of the application, as well as the timing selected for first and second peak-valve-openings 62, 64. For at least some applications, it has been found that configuring first peak-valve-opening 62 with a magnitude less than the magnitude of second peak-valve-opening 64 may work well. In some applications, first peak-valve-opening 62 may have a magnitude of between about 5 and 50 percent of second peak-valve-opening 64. More specifically, for at least some applications, first peak-valve-opening 62 may have a magnitude of between about 10 and 25 percent of second peak-valve-opening 64.

The design of a compression-braking mode of operation according to the present disclosure is not limited to the examples discussed above and shown in FIG. 2. For instance, the timing, magnitude, and/or profile of first peak-valve-opening 62 and second peak-valve-opening 64 may vary from the examples discussed above. Similarly, engine controls 22 may not close valve 38 between first peak-valve-opening 62 and second peak-valve-opening 64. Furthermore, in addition to first peak-valve-opening 62, second peak-valve-opening 64, and primary-exhaust-valve-event 70, engine controls 22 may open valve 38 at other points during the compression and/or expansion strokes, including, but not limited to, between first peak-valve-opening 62 and second peak-valve-opening 64. Moreover, the design of the timing and/or profiles of first peak-valve-opening 62 and/or second peak-valve-opening 64 may be based on various other parameters, in addition to, or instead of, those discussed above.

It will be apparent to those skilled in the art that various modifications and variations can be made in the disclosed compression-braking system without departing from the scope of the disclosure. Other embodiments of the disclosed compression-braking system will be apparent to those skilled in the art from consideration of the specification and practice of the compression-braking system disclosed herein. It is intended that the specification and examples be considered as exemplary only, with a true scope of the disclosure being indicated by the following claims and their equivalents.

What is claimed is:

1. A method for controlling compression-braking performance of an engine having a piston in a combustion cylinder, the method comprising:

providing a valve in fluid communication with the combustion cylinder and at least one valve actuator operable to control the valve to perform compression-braking by opening the valve, including opening the valve to a first peak-valve-opening during a compression stroke of the piston and opening the valve to a second peak-valve-opening before a second half of an expansion stroke of the piston;

determining a target value for a stress in the at least one valve actuator; and designing the magnitude and timing of the first peak-valve-opening as a function of the target for the stress in the at least one valve actuator.

2. The method of claim 1, wherein:

the at least one valve actuator includes a hydraulic-braking-housing; and the target value for the stress in the at least one valve actuator is a target value for pressure in the hydraulic-braking-housing.

3. The method of claim 1, further including:

determining a target value for a compression-braking power of the engine; and wherein designing the magnitude and timing of the first peak-valve-opening includes designing the magnitude and timing of the first peak-valve-opening as a function of the target value for the compression-braking power of the engine, in addition to the target value for the stress in the at least one valve actuator.

4. The method of claim 1, further including:

determining a target for a pressure in the combustion cylinder during at least one of the compression stroke and the expansion stroke; and wherein designing the magnitude and timing of the first peak-valve-opening includes designing the magnitude and timing as a function of the target for the pressure in the combustion cylinder, in addition to the target for the pressure in the at least one valve actuator.

5. The method of claim 1, further including:

determining a target for noise output of compression-braking of the engine; and wherein designing the magnitude and timing of the first peak-valve-opening includes designing the magnitude and timing as a function of the target for noise output of compression-braking, in addition to the target for the pressure in the at least one valve actuator.

6. The method of claim 1, wherein designing the magnitude and timing of the first peak-valve-opening as a function of the target for the stress in the at least one valve actuator includes at least one of advancing the timing of the first peak-valve-opening and increasing the magnitude of the first peak-valve-opening if it is desired to decrease stress in the at least one valve actuator.

7. An engine, comprising:

a combustion cylinder;

a piston disposed in the combustion cylinder; and engine controls configured to operate the engine in a compression-braking mode, including a valve in fluid communication with the combustion cylinder, an injector cam and at least one valve actuator that actuate the valve during compression-braking of the engine, wherein the injector cam includes a first peak that drives the at least one valve actuator to increase an opening of the valve a first time to a first peak-valve-opening after about 120 crankshaft degrees before top dead center of a compression stroke of the piston during compression-braking mode, and wherein the injector cam includes a second peak that drives the at least one valve actuator to increase the opening of the valve a second time to a second peak-valve-opening before a second half of an expansion stroke of the piston during compression-braking mode.

8. The engine of claim 7, wherein the first peak-valve-opening occurs between about 90 and 210 crankshaft degrees before the second peak-valve-opening.

9. The engine of claim 8, wherein the first peak-valve-opening has a magnitude of between about 5 and 50 percent of the second peak-valve-opening.

10. The engine of claim 7, wherein the first peak-valve-opening has a magnitude of between about 5 and 50 percent of the second peak-valve-opening.

11. The engine of claim 7, wherein the at least one valve actuator closes the valve between the first peak-valve-opening and the second peak-valve-opening.

12. The engine of claim 7, wherein the first peak-valve-opening occurs at least about 60 crankshaft degrees before top dead center of the compression stroke.

13. A method of operating an engine having a piston in a combustion cylinder, comprising:

performing compression-braking with the engine, including releasing a first pulse of pressure from the combustion cylinder during a compression stroke of the piston, and subsequent to releasing the first pulse of pressure from the combustion cylinder, releasing a second pulse of pressure from the combustion cylinder before a second half of an expansion stroke of the piston.

14. The method of claim 13, wherein releasing the first pulse of pressure from the combustion cylinder during the compression stroke includes releasing the first pulse of pressure at a time based at least in part on a target value for a stress in the at least one valve actuator.

15. The method of claim 14, wherein releasing the first pulse of pressure from the combustion cylinder during the compression stroke further includes releasing the first pulse of pressure at a time based at least in part on a target value for a compression-braking power of the engine.

16. The method of claim 15, wherein releasing the first pulse of pressure from the combustion cylinder during the compression stroke includes releasing the first pulse of pressure at a time based at least in part on a target value for a pressure in the combustion cylinder during at least one of the compression stroke and the expansion stroke.

17. The method of claim 13, wherein releasing the first pulse of pressure from the combustion cylinder during the compression stroke includes releasing the first pulse of pressure at a time based at least in part on a target value for a compression-braking power of the engine.

18. The method of claim 13, wherein releasing the first pulse of pressure from the combustion cylinder includes releasing the first pulse of pressure from the combustion cylinder between about 90 and 210 crankshaft degrees before releasing the second pulse of pressure from the combustion cylinder.

19. The method of claim 13, wherein releasing the first pulse of pressure from the combustion cylinder during the compression stroke includes releasing the first pulse of pressure at a time based at least in part on a target value for noise output of compression-braking of the engine.

20. The method of claim 13, wherein:

releasing the first pulse of pressure from the combustion cylinder includes increasing an opening of a valve in fluid communication with the combustion cylinder to a first peak-valve-opening;

releasing the second pulse of pressure from the combustion cylinder includes opening the valve to a second peak-valve-opening; and performing compression-braking with the engine further includes closing the valve between the first peak-valve-opening and the second peak-valve-opening.

* * * * *

UNITED STATES PATENT AND TRADEMARK OFFICE

CERTIFICATE OF CORRECTION

PATENT NO. : 8,689,769 B2
APPLICATION NO. : 12/662937
DATED : April 8, 2014
INVENTOR(S) : Afjeh et al.

It is certified that error appears in the above-identified patent and that said Letters Patent is hereby corrected as shown below:

In the Specification

Column 6, line 57, delete “peak-valve-open ing 62” and insert -- peak-valve-opening 62 --.

Signed and Sealed this
Twenty-second Day of September, 2015

Michelle K. Lee

Michelle K. Lee
*Director of the United States Patent and Trademark Office*